United States Patent [19]

Tarrson et al.

[11] Patent Number: 4,805,252

[45] Date of Patent: Feb. 21, 1989

[54] TOOTHBRUSH

[75] Inventors: Emanuel B. Tarrson; Dane Maric, both of Chicago, Ill.

[73] Assignee: John O. Butler Company, Chicago, Ill.

[21] Appl. No.: 108,129

[22] Filed: Oct. 13, 1987

[51] Int. Cl.[4] ..... A46B 3/08; A46B 3/18; A46B 9/04

[52] U.S. Cl. ..... 15/167.1; 15/176.1; 279/1 B

[58] Field of Search ..... 15/167.1, 167.2, 206, 15/176; 433/127, 128, 147; 279/1 B, 76, 84

[56] References Cited

U.S. PATENT DOCUMENTS

| | | | |
|---|---|---|---|
| 3,204,275 | 9/1965 | Baker | 15/167.1 X |
| 4,222,143 | 9/1980 | Tarrson et al. . | |
| 4,395,943 | 8/1983 | Brandli . | |
| 4,534,081 | 8/1985 | Spademan | 15/167.1 |

OTHER PUBLICATIONS

PCT Document WO 86102532, May 9, 1986.

Exhibit 1–Pictures of Dental Products Sold Under the Name "Isola".

Exhibit 2–A Photocopy of an Oral B Interproximal Brush.

Exhibit 3–Photos of Three (3) Brushes: "Tip-A-Dent", Wisdom, Oral-B.

*Primary Examiner*—Peter Feldman

*Attorney, Agent, or Firm*—Laff, Whitesel, Conte & Saret

[57] ABSTRACT

An interdental toothbrush has a refill with a twisted wire stem which has a molded plastic encasement over the end thereof. A toothbrush handle has a hole with internal contours which complement the external contours of the plastic encasement. A sleeve slides over the hole to capture and entrap the brush.

11 Claims, 1 Drawing Sheet

TOOTHBRUSH

This invention relates to twisted wire refill brushes and more particularly to refills for personal hygiene brushes, such as toothbrushes, for example.

Reference is made to U.S. Pat. No. 4,222,143 for an example of a brush which might reasonably use the inventive refill. This patent shows an interdental brush handle which receives a twisted wire brush that projects outwardly therefrom. Such a brush is used for brushing in and around space between teeth. For example, the brush might be used to clean a space under a dental bridge in the back of the mouth.

A number of problems are presented by the use of refill brushes, in a handle, such as this. Very often the people who are most likely to need to clean the area under a dental bridge are aged, infirm, or have impaired hand motion. For them, a need to manipulate small parts may become an overpowering chore.

Another problem is that, if a metal chuck is used to hold the wire brush, the twisted wire stem of the brush may become nicked or so bent out of shape as to become useless. If an all plastic chuck is used to hold the brush, the manipulative problems may be enhanced. With all of these and similar arrangements, there is a problem if the instructions are not carefully followed since the brush may then loosen in the chuck. If this happens, the user may no longer control brush motion, with a possible nicking of tooth enamel, jabbing of gum tissue, etc.

For these and similar reasons, an effort has been made to eliminate judgment and skill, heretofore required to install a refill brush in a handle. Among other things, this has involved an encasing of the stem of a twisted wire refill brush in plastic. The fit between the plastic encased stem and a receiving socket in the handle can be made with a high level of precision since that precision may be provided by contours of a mold. Thus, the refill brush always has a perfect fit when placed in the handle. However, the refill brushes of this type have not heretofore been locked in place in the handle. Therefore, the brushes were not always as tightly held or as precisely positioned as they could have been held or positioned.

Accordingly, an object of the invention is to provide new and improved twisted wire brush refills. In particularly, an object is to provide such refills which may be easier to use by those whose hands lack conventional small muscle manipulative skills or who are inattentive to refill loading procedures.

A further object is to provide a refill with a twisted wire stem encased in plastic with a positive position lock.

Another object of the invention is to provide superior toothbrushes with a firmer grip upon the brush. Here, an object is to reduce the unsupported length of a twisted wire stem which might bend during use. In this connection, an object is to require the user to properly seat the brush stem so that only the correct amount of the stem projects from the handle.

Still another object is to provide for an interchangeable use of both a toothpick and a brush refill on each end of the handle.

In keeping with an aspect of the invention, these and other objects are accomplished by an elongated, all plastic toothbrush handle having a smooth and unthreaded sleeve which slides back and forth along its terminal end portion. A transverse hole pierces the tip end of the handle, the hole having a counter-sunk or keyed diameter which is shaped to easily receive a plastic collar molded on a plastic encased twisted wire stem. The shapes of the hole and the collar are complementary so that the brush fits into the hole with little, if any, resistance, but will not develop a significant amount of wiggling movement. The sleeve slides over the collar and snaps around the plastic encased wire stem, which holds the brush locked in a chuck-like grip. The external dimensions of the plastic encased wire stem are approximately the same as the external dimensions of a toothpick. Therefore, either the brush or a toothpick may be used on either or both ends of the handle.

A preferred embodiment of the invention is shown in the attached drawing, wherein.

Figure 1:
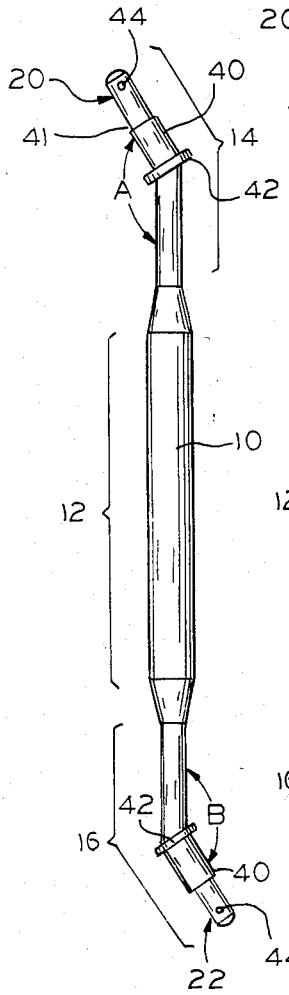
FIG. 1 is a plan view of a toothbrush handle which may use the inventive refill.
Figure 2:
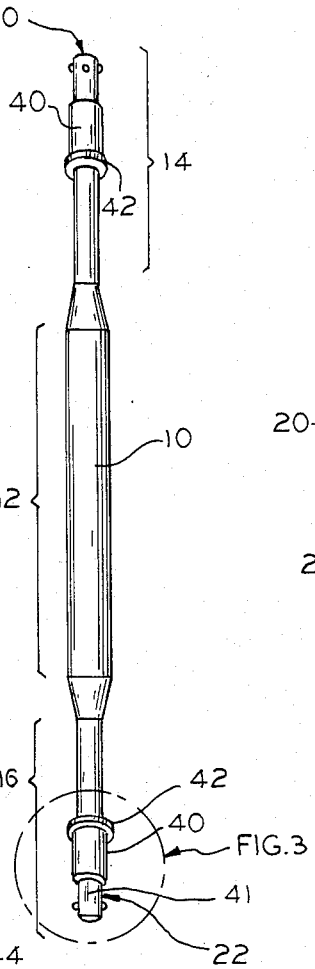
FIG. 2 is a similar plan view of the same handle taken in a plane lying at right angles to the plane of FIG. 1.

The inventive handle (FIGS. 1 and 2) comprises a generally elongated handle member 10 which has a thickened central region 12, terminated on either end in sections 14, 16 of reduced diameter. Each of these end sections 14, 16 is bent at an angle A, B of approximately 160° to 150° with respect to the axis of the elongated handle member 10. At each end section 20, 22 of the handle 10, there is a transverse hole or bore 23 extending through the end sections 20, 22 of the handle, the axis of the hole being in the plane including the angles A and B. Preferably, the handle is made from a molded plastic.

Figure 4:
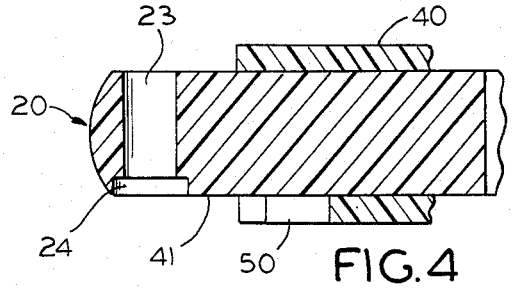
FIG. 4 is a cross section of the end fragment of the handle taken along lines 4—4 in FIG. 3.

The hole or bore 23 is counter sunk at 24 (FIG. 4) and has a diameter which is only a very small amount greater than the diameter of a collar 32 (FIG. 5) of a plastic encasement 26 which is molded around pair of twisted wires 28 (preferably stainless steel) which form the stem and anchored end of the interdental brush 30. Therefore, the brush stem has an anchor member formed thereon by an upstanding plastic engagement and anchor stem 26 and its integral and dependent collar 32. The anchor stem slips easily through the hole or bore 23 while collar 32 fits into the counter sunk area 24, but the clearance is small enough so that stem 26 and collar 32 do not wiggle within the hole, to any significant degree.

The dimensions and contour of hole or bore 23 is such that it also receives, with a snug fit, an end of a preferably wooden toothpick which fits through the hole with sufficient friction to hold it in place. Since the holes 23 on opposite ends of the toothbrush handle, have the same contours, either a brush or a toothpick may be installed on either or both ends of the handle.

Figure 5:
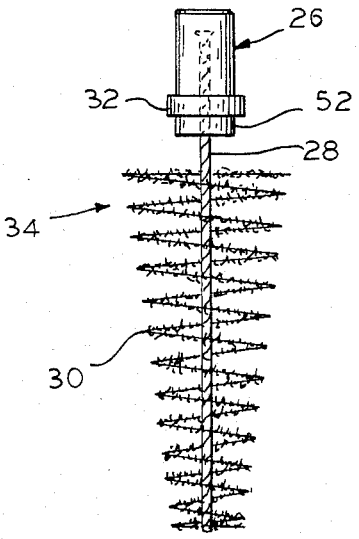
FIG. 5 is a side elevation of the inventive refill brush showing a plastic encased twisted wire stem, with a locking collar.
Figure 6:
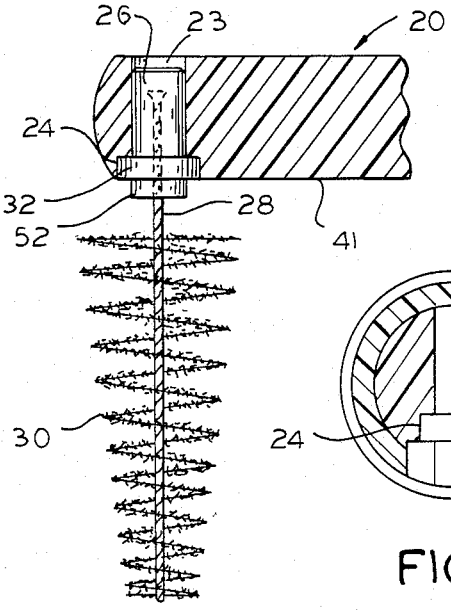
FIG. 6 is a combination of FIGS. 4 and 5, showing the inventive refill brush in place in the handle.
Figure 8:
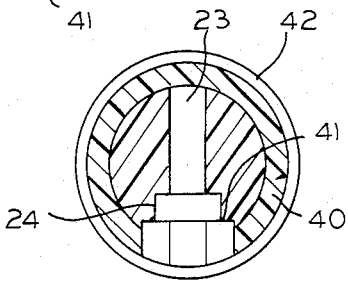
FIG. 8 is an end view taken along line 8—8 of FIG. 7, without the brush.

The refill brush 34 is best seen in FIG. 5, as including a brush which is more or less conventional in its twisted wire construction. It may have any of many different shapes which serves interdental and root brushing needs, such as conical and cylindrical shapes. Also, these brushes may have both relatively thin bristles to make a brush of medium hardness, or relatively thick bristles to make a hard brush. These bristles may be either natural or a plastic, preferably nylon. Any of these or similar brush constructions may be used with the inventive plastic encased twisted wire spring.

To the conventional brush 34 is added a molded plastic encasement 26 and collar 32 which may be attached around the twisted wire stem 28 in any suitable manner, as by being molded in place. A fixed length 36 of the wire stem 28 remains between the collar 32 and the brush 30. An advantage of this arrangement is that the fixed length 36 is short enough to preclude the kind of kinking which results from too long an unsupported length of the wire stem which may occur if the user simply feeds a length of bare twisted wires 28 through a hole in the handle. On the other hand, the length 36 is sufficient to enable the brush to function properly. Therefore, a provision of the collar 32 insures a consistent and correct wire stem length.

The plastic encasement 26 and collar 32 and the hole 23 and counter sunk hole 24 have complementary contours to insure a proper brush-to-handle fit. The collar or enlarged flange 32 is dimensioned to fit into the counter sunk region 24 of the hole 23, thereby fixing the distance by which the brush projects. This stabilizes the brush against wiggling.

Figure 7:
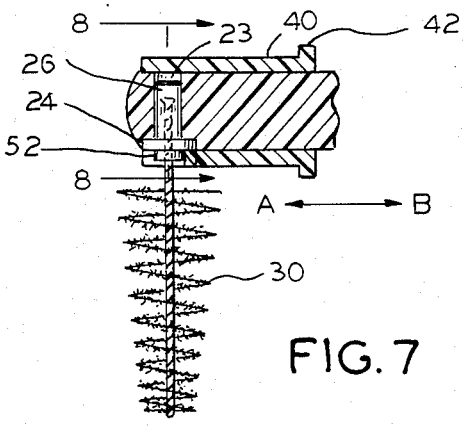
FIG. 7 is the same view that is shown in FIG. 6 except that a sleeve has moved over and snapped around the brush to capture and lock it in place.

A sleeve 40 (FIGS. 1, 2, 7, 8) is shaped and proportioned to slide back over the reduced diameter end section 14, 16 of the handle, far enough to expose all of the hole 23 and counter sunk region 24 or forward far enough to lock the brush in place (FIG. 7). The interior of the sleeve has a contour which is somewhat cylindrical throughout a first length nearest the hole 23. The contour is slightly tapered throughout a second length to assist in slipping the sleeve over the end of the handle, at the time of manufacture. The bottoms 41 of the end sections 20, 22 are flat to assist in capturing collar or enlarged flange 32 of the brush. The sleeve 40 terminates in a strengthening ridge 42 which also assists in holding and moving it.

Each of the tip ends of the handle includes two oppositely disposed projections 44, 46 which limit the forward sleeve motion. Preferably, during assembly after manufacture, the sleeve 40 may be forced over these projections and on to the handle, but it will not thereafter fall off the handle unless pulled with a substantial force. In part, this is because the internally tapered section acts as a guide for slipping the sleeve over the projections 44, 46, but the outer end of the sleeve tends to abut against the projections and prevent removal of the sleeve when there is no brush in the hole 23.

Figure 3:
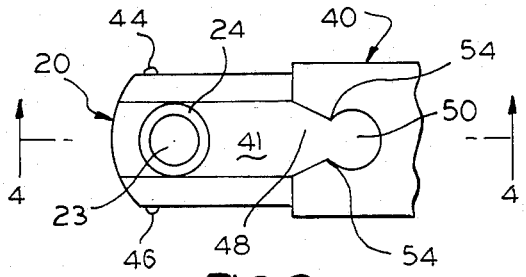
FIG. 3 is an enlarged view of an end fragment of the handle, taken at dot-dashed circle 3 in FIG. 2, with a retracted sleeve.

The lower surface of the sleeve (FIG. 3) contains a somewhat funnel shaped opening 48 leading into a circular opening 50. When the refill brush (FIG. 5) is in place, the sleeve 40 is slid over it (direction A, FIG. 7). The funnel shaped opening 48 guides and directs a section 52 under the collar 32 into circular opening 50. The shoulders 54, 54 at the entrance to opening 50 snap a capture part 52 below collar 32, thus entrapping the brush and capturing collar 32 inside the counter sunk area 24 of the hole 23. To remove and replace the refill brush 34, the sleeve 40 is first slid back in a direction B, thus releasing the part collar from the counter sunk circular opening 24. Then, the bursh is pulled from the hole. A new brush is inserted, and sleeve 40 is slid back in direction A, to capture the brush.

Those who are skilled in the art will readily perceive how to modify the invention. Therefore, the appended claims are to be construed to cover all equivalent structures which fall within the true scope and spirit of the invention.

The claimed invention is:

1. A refill and toothbrush comprising a twisted wire brush having a stem with a plastic encasement molded thereon, said plastic encasement including an enlarged collar between an anchor stem and said brush and a capture part beneath the collar, and a toothbrush handle having a hole therein with internal contours which are complementary to at least part of the external contours of said plastic encasement.

2. The refill and toothbrush of claim 1 and capture means associated with said handle for capturing said plastic encasement.

3. The refill and toothbrush of claim 2 wherein said capture means is a sleeve which slides along said handle between positions which capture and release said collar.

4. The refill and toothbrush of claim 3, wherein said sleeve includes a funnel shaped opening leading through capture shoulders to an opening for surrounding said capture part.

5. The refill and toothbrush of claim 4 wherein said sleeve fits snugly over said collar when said plastic encasement is in said hole.

6. The refill and toothbrush of claim 5 wherein said hole extends perpendicularly through said toothbrush handle.

7. A toothbrush comprising an elongated handle having opposing ends of reduced diameter with sleeves slidably mounted on said reduced diameter ends, a hole transversely extending at least part way through said handle at a position where said sleeve may cover or uncover said hole, a counter sunk area at one end of said hole, a twisted wire spring brush having plastic molded around the end of said twisted wire with external contours which are complementary to the internal contours of said hole and said counter sunk area, said twisted wire emerging from said molded plastic on an end which is complementary to said counter sunk area, and a shape on said sleeve for surrounding and capturing said molded plastic when it is in place within said hole.

8. The toothbrush of claim 7 wherein said sleeve has a shape for sliding over said twisted wire stem and capturing said brush.

9. A refill and toothbrush comprising a twisted wire brush having a stem with a plastic encasement molded thereon, said plastic encasement including a collar with a capture part beneath the collar, a toothbrush handle having a hole therein with internal contours which are complementary to the external contours of said plastic encasement, capture means associated with said handle for capturing said plastic encasement, said capture means comprising a sleeve which slides along said handle between positions which capture and release said collar, said sleeve including a funnel shaped opening leading through capture shoulders to an opening for surrounding said capture part.

10. The refill and toothbrush of claim 9 wherein said handle having a counter sunk area for receiving said collar, said sleeve fitting snugly over said collar when it is in said counter sunk area.

11. The refill and toothbrush of claim 10 wherein said hole extends perpendicularly through said toothbrush handle.

* * * * *